United States Patent [19]

Chang

[11] Patent Number: 4,628,572

[45] Date of Patent: Dec. 16, 1986

[54] CLIP STRUCTURE

[76] Inventor: Shih-Ho Chang, No. 2-12, Chang Lu Road, Chang Hwa City, Taiwan

[21] Appl. No.: 660,040

[22] Filed: Oct. 12, 1984

[51] Int. Cl.[4] ..... B42F 1/00

[52] U.S. Cl. ..... 24/67.11; 24/67 R; 24/67.7; 281/45

[58] Field of Search ..... 24/67 R, 67.3, 67.5, 24/67.7, 67.9, 67.11, 457, 458, 485, 489; 281/45; 402/69

[56] References Cited

U.S. PATENT DOCUMENTS

| | | | |
|---|---|---|---|
| 1,039,571 | 9/1912 | McPherson | 24/67.11 |
| 1,609,041 | 11/1926 | Pauker | 24/67 R |
| 1,671,725 | 5/1928 | Jones | 24/67.5 |
| 2,500,468 | 3/1950 | Postell | 24/67.3 X |
| 2,516,239 | 7/1950 | Moss | 24/67.3 X |
| 2,827,719 | 3/1958 | Nairn | 24/67 R X |
| 2,862,328 | 12/1958 | Wadsworth | 24/67.7 |
| 3,105,279 | 10/1963 | Westhoff | 24/67.5 |
| 3,125,789 | 3/1964 | Parker | 24/67.9 |
| 3,297,862 | 1/1967 | Levy et al. | 24/67.5 X |
| 3,968,546 | 7/1976 | Seaborn et al. | 24/67.11 X |

FOREIGN PATENT DOCUMENTS

| | | | |
|---|---|---|---|
| 515189 | 11/1952 | Belgium | 24/67.11 |
| 495562 | 11/1952 | Italy | 24/67.11 |
| 26218 | of 1903 | United Kingdom | 24/67.7 |
| 16652 | of 1915 | United Kingdom | 24/67.7 |

*Primary Examiner*—William E. Lyddane
*Assistant Examiner*—Laurie K. Cranmer
*Attorney, Agent, or Firm*—Birch, Stewart, Kolasch & Birch

[57] ABSTRACT

Since the utilization of U-shaped bracket of the present invention, the clipboard obviates the use of rivets in assembly, and the clamping bodies of a clip can be formed by injection molding. Therefore, the present invention simplifies the manufacturing process in making a clipboard or a clip, and provides the advantages of easily assembling and low cost.

14 Claims, 16 Drawing Figures

CLIP STRUCTURE

BACKGROUND OF THE INVENTION

The present invention is related to an improved clip structure, and more particularly to an improved clip structure of a clipboard which obviates the use of rivets in assembly.

Rivets are normally required in the conventional clipboard. A conventional clipboard as shown in FIGS. 1*a*, 1*b*, and 1*c* comprises a board 51, a clamping member 52, a supporting base 53, a torsional spring 54, and a pivotal axle 55. The supporting base 53 is joined with the board 51 by means of two rivets 62. The clamping member 52 is pivotally connected to two projections 63 upwardly protruding from the supporting base 53 by the pivotal axle 55, and cooperates with the board 51 to form a clamping device. The torsional spring 54 is arranged between the clamping member 52 and the supporting base 53 to bias the clamping member 52 abutting against the board 51. Since the conventional clipboard utilizes rivets to secure the supporting base 53 to the board 51, such clipboard is inconvenient to assemble and relatively expensive to produce.

An improved clip structure according to the preferred embodiments of the present invention intendes to improve on the above-described disadvantages.

SUMMARY OF THE INVENTION

One object of the present invention is to provide clipboard which obviates the use of rivets.

Another object of the present invention is to provide a clipboard which cost is reduced due to the simplification of the manufacturing process.

Yet another object of the present invention is to provide a clip which cost is reduced due to the simplification of the manufacturing process.

In accordance with the present invention, a clipboard comprises a board having a slot near one of its ends; a support bracket movably attached to one side of the board and having two extension portions passing through the slot and protruding out of the reverse side of the board; a clamping member having an end, and cooperating with the board to form a clamping device, being pivotally connected to the two extension portions; and a spring member biasing the end to abut against the board, being disposed between the clamping member and the board, so as to concurrently bias the board to firmly abut against the support bracket.

In addition, in accordance with the improved clip structure of the present invention, a clip comprises two clamping bodies, two U-shaped brackets engaged with the clamping bodies respectively, and pivotally connected with each other at the corresponding two folded portions of the U-shaped brackets, so that the clamping bodies are cooperated to form a clamping device and are capable of pivotally rotating in relation to each other, and a spring member disposed between the two clamping bodies to urge the clamping bodies to abut against each other at one of their ends.

BRIEF DESCRIPTION OF THE DRAWINGS

The present invention will be more fully understood from the following detailed description, taken in connection with the accompanying drawings which form an integral part of this application and in which.

DETAILED DESCRIPTION OF THE PREFERRED EMBODIMENTS

Figure 1A:
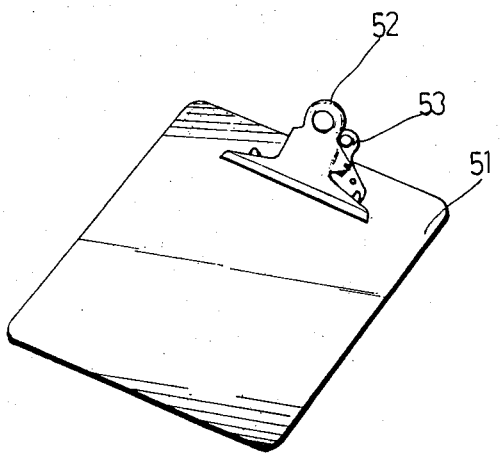
FIG.1a PRIOR ART
FIG. 1*a* is a perspective view of a conventional clipboard.
Figure 1B:
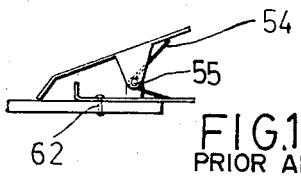
FIG.1b PRIOR ART
FIG. 1*b* is a partial elevational view of the clipboard of FIG. 1*a*.
Figure 1C:
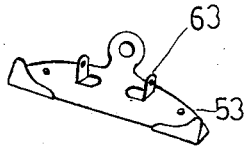
FIG.1c PRIOR ART
FIG. 1*c* is a perspective view showing a supporting base of the clipboard of FIG. 1*a*.
Figure 2A:
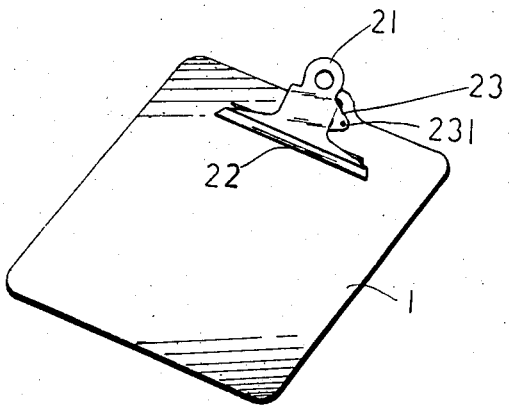
FIG. 2*a* is a perspective view of a clipboard in accordance with one preferred embodiment of the present invention.
Figure 2B:
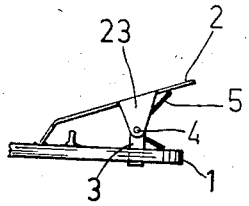
FIG. 2*b* is a partial elevational view of the clipboard of FIG. 2*a*.
Figure 2C:
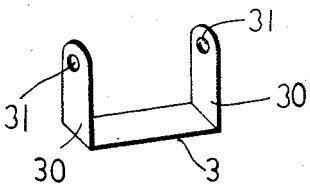
FIG. 2*c* is a perspective view showing a U-shaped bracket of the clipboard of FIG. 2*a*.
Figure 3:
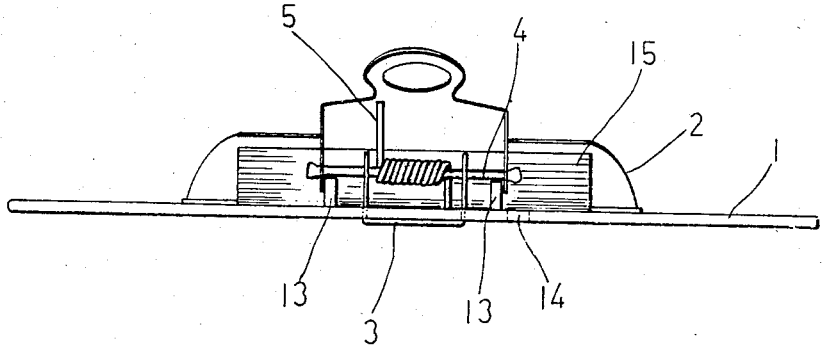
FIG. 3 is a rear elevational view of the clipboard of FIG. 2*a*.
Figure 4:
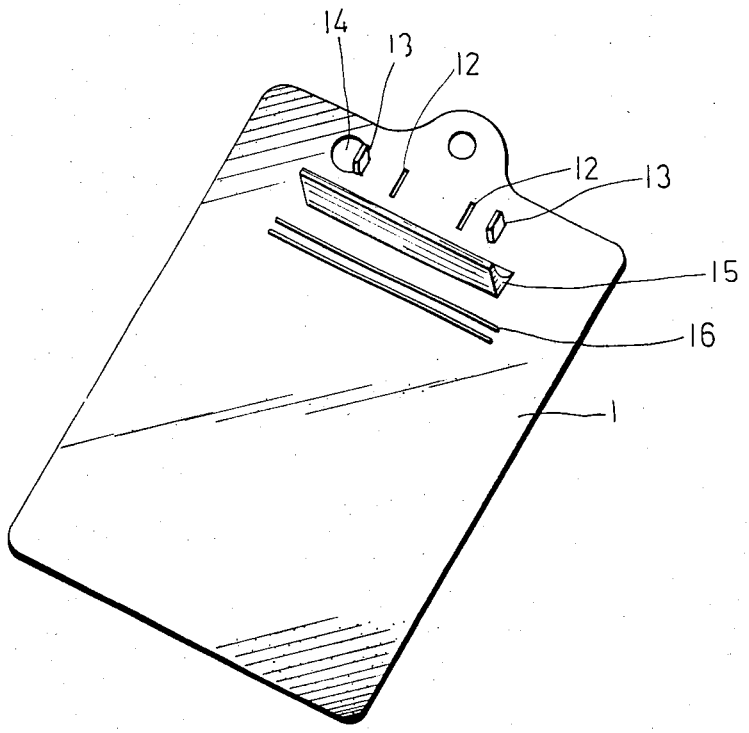
FIG. 4 is a perspective view showing a board of the clipboard of FIG. 2*a*.

Referring now to the drawings, it should be noted that a like member is designated with a like reference number. FIGS. 2 to 4 show a clipboard in accordance with first preferred embodiment of the present invention, comprising a board 1, a clamping member 2, a U-shaped bracket 3, and a spring member 5. The board 1 has a pair of slots 12, especially shown in FIG. 4, in parallel near one of its ends. However, for those of ordinary skill in the art, it is obvious that it is possible to substitute one U-shaped slot, or the like, for the slots 12. Two first fold portions 30 of the U-shaped bracket 3 pass through the slots 12 from the bottom side of the board 1 and protrudes out of the top side of the board 1. The bottom portion of the U-shaped bracket 3 attaches to the bottom side of the board 1. Each first folded portions 30 has a first hole 31 therethrough, as shown in FIG. 2*c*. The clamping member 2 has two lugs 23, each has a second hole 231 therethrough, downwardly extending from its two opposite edges at the midsection for being pivotally connected to the first folded portions 30 respectively. The pivot connections between the first folded portions 30 and the lugs 23 are achieved, in this embodiment, by utilizing an axle 4 extending completely through two first holes 31 and the two second holes 231. The spring member 5 is a torsional spring, especially referring to FIG. 3, and is arranged around the periphery of the axle 4 with one end abutting against the clamping member 2 and the other end abuting against the board 1. Thus, the spring member 5 biases the front edge of the clamping member 2 to abut against the board 1 and concurrently biases the board 1 to firmly abut against the U-shaped bracket 3.

Referring to FIG. 3, the board 1 includes a pair of struts 13 projecting therefrom to support the axle 4 on their tops. The distance between the struts 13 is slightly smaller than that between the lugs 23, thereby the clamping member 2 will be restricted at a specific position by the struts 13. The axle 4 is formed into one end in a flat shape and the other end a round shape is utilized to insert through the first and second holes 31 and 231. An opening 14 extends through the board 1 beside one of the struts 13 for inserting a tool, such as a punch, to press the round-shaped end of the axle 4 into a flat shape, whereby the azle 4 is firmly secured. Referring to FIG. 4, the board 1 also includes a stopper 15 and a pair of ridges 16. The stopper 15 is utilized to stop the papers which are clipped on the board 1 by the clamping member 2, at a specific place. The ridges 16 are utilized to further keep the papers from sliding away. Since the uses of the stopper and the ridges are of prior arts, further description is unnecessary.

Figure 6:
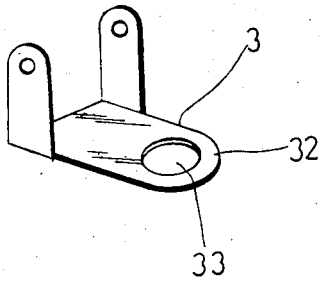
FIG. 6 is a perspective view showing a U-shaped bracket of the clipboard of FIG. 5.
Figure 5:
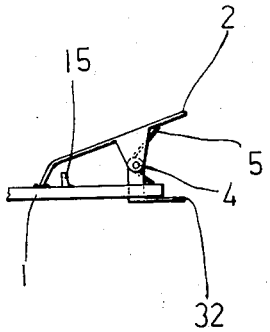
FIG. 5 is a partial elevational view of a clipboard in accordance with another preferred embodiment of the present invention.

Referring to FIGS. 5 and 6, there is shown a clipboard of the second embodiment of the present invention, this embodiment is almost similar to the first embodiment. The only difference between the first and second embodiments is that the U-shaped bracket 3 of the latter is provided with a hand hold 32 which has an aperture 33 therethrough. The hand hold 32 is utilized to cooperate with the clamping member 2 to operate the clipboard to clip the papers. Moreover, the clipboard can be hung on the wall by means of the aperture 33.

Figure 7:
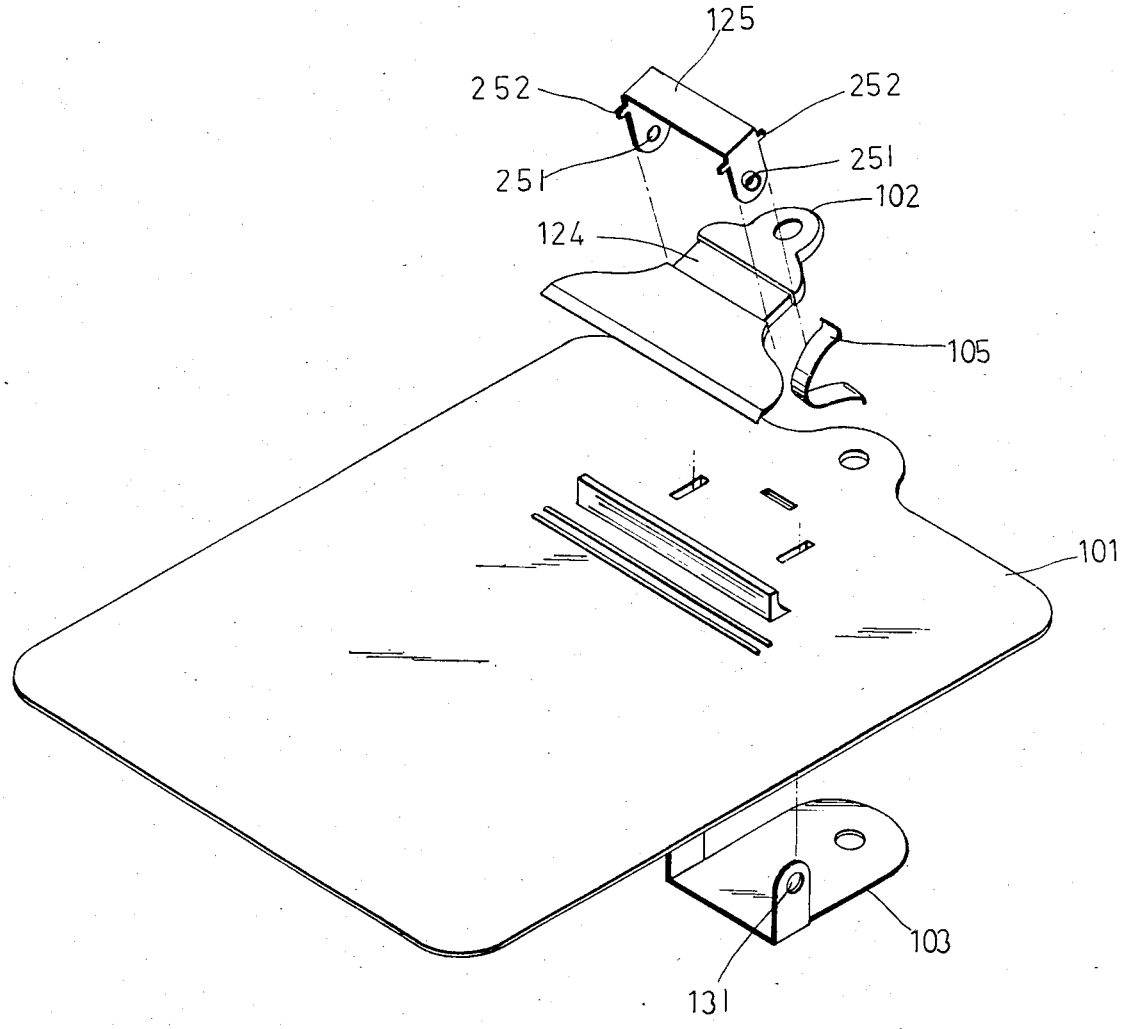
FIG. 7 is an exploded perspective view of a clipboard in accordance with yet another preferred embodiment of the present invention.
Figure 8:
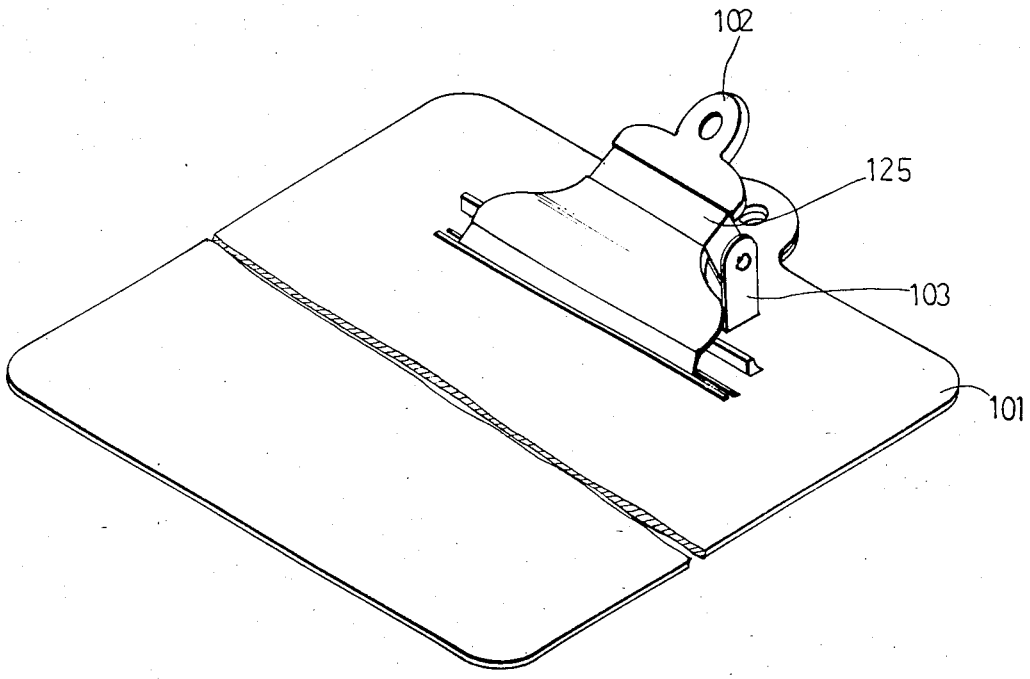
FIG. 8 is a perspective view of an assembled clipboard.
Figure 9:
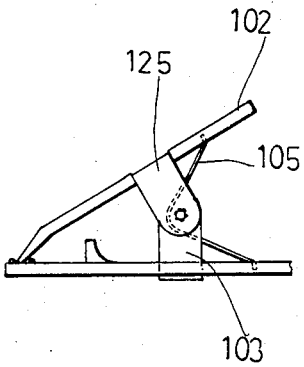
FIG. 9 is a partial elevational view of the clipboard of FIG. 8.

Particularly referring to FIGS. 7, 8, and 9, which show the third embodiment of the present invention, a clipboard comprising a board 101, a U-shaped bracket 103 which is the same as the above-described structure, a clamping body 102, a U-shaped member 125, and a spring member 105. The U-shaped bracket 103 passes through the board 101 via two slots in a manner as described above. The U-shaped member 125 engages into a groove 124 which is formed on the midsection of the clamping body 102, and four protrusions 252 which respectively protrude from four sides of two second folded portions of the U-shaped member are bent under the clamping body 102 for firmly securing the U-shaped member 125 onto the clamping body 102. Then the second folded portions are pivotally connected to two first folded portions of the U-shaped bracket 103. The pivot connection in this embodiment is achieved by utilizing two annular bosses 251 respectively arranged on two ends of the second folded portions of the U-shaped member 125 to insert into two holes 131 respectively positioned on the ends of the first folded portions of the U-shaped bracket 103, and subsequently, the annular bosses 251 being punched to turn over as shown in FIG. 8 or 9. The spring member 105 in this embodiment is a leaf spring, as shown in FIG. 7, and is arranged between the board 101 and the clamping body 102 to provide the same functions that the above-described torsional spring 5 does. The clamping body 102 and the board 101 or 1 are preferably formed by injection molding so as to reduce the cost.

Figure 12:
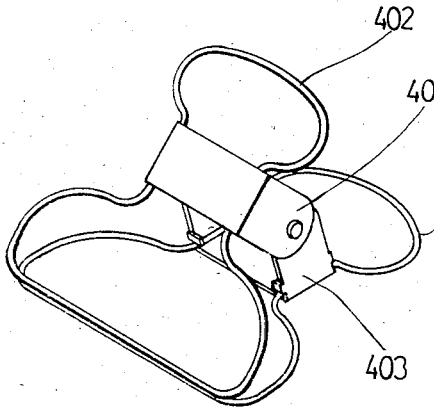
FIG. 12 is a perspective view of a clip in accordance with the present invention.
Figure 11:
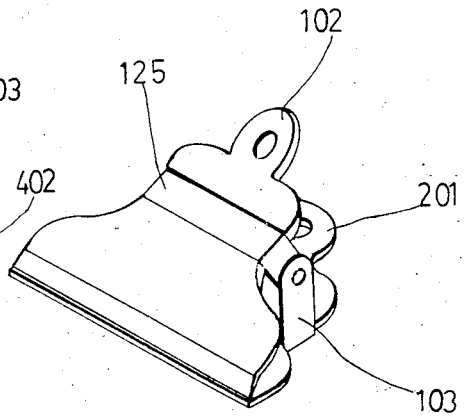
FIG. 11 is a perspective view of a clip in accordance with the present invention.
Figure 10:
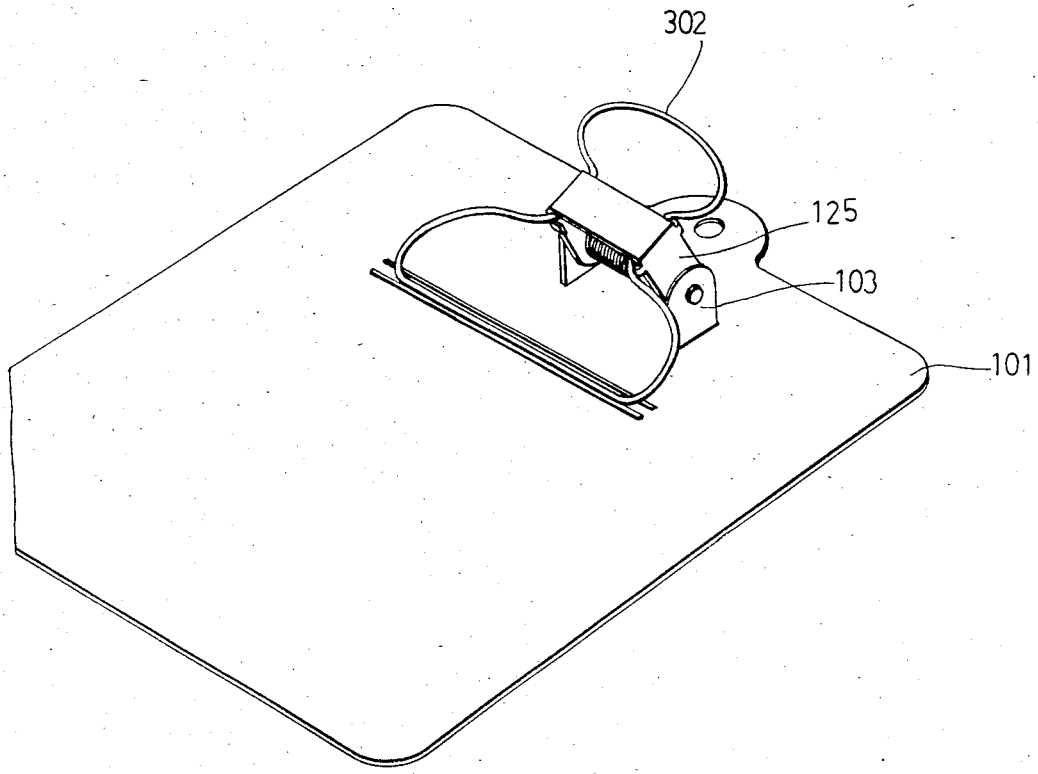
FIG. 10 is a perspective view of a clipboard in accordance with yet another preferred embodiment of the present invention.

In the third embodiment, the clamping body 102 can also be made from a length of wire bent to be formed into a desired shape, as shown in FIG. 10. Referring to FIG. 11, which shows a clip which structure is almost similar to the clipboard shown in FIG. 8 except that the board 101 is miniaturized to a second clamping body 201. In this embodiment, the material of the clamping bodies 102 and 201 are plastic, and are formed by injection molding, so that the cost of the improved clip according to the invention is lower than that of the conventional clip in which the material of the clamping members are metallic. Similarly, in FIG. 12, a clip comprises two clamping bodies 402, each of which is made from a length of wire bent to be formed into a desired shape, two U-shaped brackets 403 secured on the clamping body and pivotally connected to each other, a spring member disposed between the U-shaped bracket 403 so as to bias the clamping bodies 402 to pivotally rotate to abut against each other at their front edges.

While the invention has been described in connection with what is presently considered to be the most practical and preferred embodiment, it is to be understood that the invention is not to be limited to the disclosed embodiment but on the contrary, is intended to cover various modifications and quivalent arrangements included within the spirit and scope of the appended claims which scope is to be accorded the broadest interpretation so as to encompass all such modification and equivalent structures.

What I claim is:

1. A clipboard comprising:

a board having two slots near one of its ends;

a U-shaped bracket having a bottom portion attached to the bottom side of said board and having two first folded portions passing through said slots and protruding out of the top side of said board respectively;

a clamping member having a front edge and pivotally connected to said two first folded portions; and a spring member disposed between said clamping member and said board for biasing the front edge of said clamping member to firmly abut against said board, and for concurrently biasing said board to firmly abut against said U-shaped bracket.

2. A clipboard as claimed in claim 1, wherein said clamping member includes two lugs downwardly extending to pivotally connect to said two first folded portions respectively.

3. A clipboard as claimed in claim 2, wherein each end of said first folded portions has a first hole therethrough, each lug has a second hole therethrough, and further comprising an axle extending completely through said first holes and said second holes, so that said clamping member is capable of being pivotally rotated with respect to said U-shaped bracket.

4. A clipboard as claimed in claim 3, wherein said board includes a pair of struts disposed adjacently to said slots on said board respectively, and the distance between said struts being slightly smaller than that between said two lugs, so that said axle is supported on the tops of said struts, and said clamping member will be restricted at a specific position by said struts.

5. A clipboard as claimed in claim 4, wherein said board has an opening therethrough, which is adjacent to the outer side of one of said struts for inserting a tool to press one predetermined end of said axle into a flat shape.

6. A clipboard as claimed in claim 5, wherein said board includes a stopper projected therefrom for stopping papers, which is clipped on said board by said clamping member, at a specific place.

7. A clipboard as claimed in claim 6, wherein said board is integrally formed.

8. A clipboard as claimed in claim 1, wherein said clamping member includes a clamping body, and a U-shaped member engaged with said clamping body and pivotally connected to said first folded portions at two second folded portions of said U-shaped member.

9. A clipboard as claimed in claim 8, wherein said clamping body has a groove thereon for said U-shaped member to engage into.

10. A clipboard as claimed in claim 8, wherein said clamping body is made from a length of wire bent into a desired shape.

11. A clipboard as claimed in claim 10, wherein said spring member is a leaf spring.

12. A clipboard as claimed in claim 10, wherein said spring member is a leaf spring.

13. A clipboard as claimed in claim 8, wherein said U-shaped bracket includes a hand hold which is parallel to said board, and extends to the outside of said board from said bottom portion of said U-shaped bracket.

14. A clipboard as claimed in claim 13, wherein said hand hold has an aperture therein for hanging said clipboard.

* * * * *